US007406961B2

(12) United States Patent
Hilpert et al.

(10) Patent No.: US 7,406,961 B2
(45) Date of Patent: Aug. 5, 2008

(54) APPARATUS FOR CONTROLLING CYCLONE SEPARATORS

(75) Inventors: Torsten Hilpert, Erdmannhausen (DE); Pius Trautmann, Stuttgart (DE); Thomas Schleiden, Stuttgart (DE); Andreas Beck, Ludwigsburg (DE); Andreas Weber, Ludwigsburg (DE)

(73) Assignee: Mann & Hummel GmbH, Ludwigsburg (DE)

( * ) Notice: Subject to any disclaimer, the term of this patent is extended or adjusted under 35 U.S.C. 154(b) by 215 days.

(21) Appl. No.: 11/292,080

(22) Filed: Dec. 2, 2005

(65) Prior Publication Data

US 2006/0112941 A1 Jun. 1, 2006

Related U.S. Application Data

(63) Continuation of application No. PCT/EP2004/050972, filed on Jun. 1, 2004.

(30) Foreign Application Priority Data

Jun. 2, 2003 (DE) ..... 103 25 055

(51) Int. Cl.
*F01M 13/04* (2006.01)

(52) U.S. Cl. ..... 123/572

(58) Field of Classification Search ..... 123/572–574, 123/41.86

See application file for complete search history.

(56) References Cited

U.S. PATENT DOCUMENTS

| | | | | |
|---|---|---|---|---|
| 6,279,556 | B1 * | 8/2001 | Busen et al. | 123/572 |
| 6,422,224 | B1 | 7/2002 | Walker, Jr. | |
| 6,626,163 | B1 * | 9/2003 | Busen et al. | 123/572 |
| 6,684,864 | B1 | 2/2004 | Busen et al. | |
| 6,942,709 | B2 | 9/2005 | Trautmann et al. | |
| 2002/0100465 | A1 * | 8/2002 | Pietschner | 123/572 |
| 2003/0024512 | A1 | 2/2003 | Kitano et al. | |

FOREIGN PATENT DOCUMENTS

| | | |
|---|---|---|
| DE | 199 18 311 A1 | 11/2000 |
| DE | 100 44 922 A1 | 4/2002 |
| DE | 102 05 981 A1 | 8/2003 |
| GB | 1 255 642 | 12/1971 |
| WO | WO 00/65206 | 11/2000 |

OTHER PUBLICATIONS

International Search Report dated Sep. 24, 2004, based on International Application No. PCT/EP2004/050972.

* cited by examiner

*Primary Examiner*—M. McMahon
(74) *Attorney, Agent, or Firm*—Crowell & Moring LLP

(57) ABSTRACT

Apparatus for separating oil from crankcase ventilation gases of an internal combustion engine having at least two oil separators in the form of cyclones connected in parallel and traversed by the crankcase ventilation gases. The apparatus is equipped with a control valve that divides the volumetric flow of the crankcase ventilation gases into at least two subflows, depending on the magnitude of the volumetric flow, and conducts the subflows to the at least two oil separators. A control piston releases or blocks access of the gases to additional cyclones depending on the dynamic pressure of the crankcase gas.

8 Claims, 3 Drawing Sheets

APPARATUS FOR CONTROLLING CYCLONE SEPARATORS

CROSS REFERENCE TO RELATED APPLICATIONS

This application is a continuation of international patent application no. PCT/EP2004/050972, filed Jun. 1, 2004, designating the United States of America, and published in German as WO 2004/105955 on Dec. 9, 2004, the entire disclosure of which is incorporated herein by reference. Priority is claimed based on Federal Republic of Germany patent application no. DE 103 25 055.7, filed Jun. 2, 2003.

BACKGROUND OF THE INVENTION

The present invention relates to an apparatus for switching or controlling cyclone separators. Cyclone separators are used, for example, in the crankcase ventilation of internal combustion engines. They serve to separate the crankcase gas from liquid components, such as oil mist. The crankcase gas is set into rotation inside the cyclone separator. The oil mist or oil droplets are deposited along the wall of the cyclone separator and flow back into an oil pan via a discharge pipe. The deoiled gas is conducted to the intake tract of the internal combustion engine via a pressure control valve and is returned to the intake air.

The amount of crankcase gas depends on the operating state of the engine and may range, for example, from 50 to 220 liters per minute. A cyclone separator has an optimal operating point at a specific gas amount. To reliably deoil the different amounts of gas, a plurality of switchable cyclones must be provided, which are switched on or off depending on the gas amount. Approaches to solve this problem are known, e.g., the use of additional valves to switch the cyclones on or off.

U.S. Pat. No. 6,684,864 (=DE 199 18 311) discloses a method for deoiling crankcase ventilation gases and an apparatus for carrying out this method. In this device, the volumetric flow of the crankcase gases is divided into at least two partial streams, and at least one partial stream is guided through at least one oil separating element. The size of the partial streams is regulated as a function of the magnitude of the volumetric flow.

U.S. Pat. No. 6,942,709 (=DE 102 05 981) discloses a system with switchable cyclones for separating particles or droplets from a fluid stream. At least two cyclones, which have a tangential inlet opening for the fluid stream, are connected in parallel. Each inlet opening for the fluid stream can be opened or closed individually. Controlling the fluid stream is very important for the optimal deoiling of crankcase gases because the optimal efficiency of the cyclones is limited to a very narrow operating range. Control of the volumetric flow must therefore be designed precisely for this optimal operating range. On the other hand, the system should be simple in construction and have little or no tendency to malfunction.

SUMMARY OF THE INVENTION

Accordingly, it is an object of the present invention to provide an improved apparatus for controlling a flow of gas to one or more cyclone separators.

Another object is to provide an apparatus that makes it possible to reliably control a flow of crankcase ventilation gas to one or more cyclones to maintain optimum cyclone performance.

A further object is to provide an apparatus for controlling a flow of gas to one or more cyclones which can effectively adapt to a variable volume flow of gas.

It is also an object of the invention to provide an apparatus for controlling a flow of gas to one or more cyclones which has a simple and reliable construction.

These and other objects are achieved in accordance with the presently claimed invention by providing an apparatus for separating oil from crankcase ventilation gases of an internal combustion engine, the apparatus comprising at least two oil separator cyclones connected in parallel through which the crankcase ventilation gases flow, and a control member which divides the volumetric flow of the crankcase ventilation gases into partial streams depending on the size of the volumetric flow and guides the partial streams into the at least two oil separator cyclones, the control member comprising a control plunger and a compression spring which urges the control plunger against the pressure of the crankcase gases, the control plunger opening or blocking access of the gases to additional cyclones depending on the dynamic pressure of the gases.

An advantage of the invention is that a control plunger is provided. This control plunger is configured in such a way that it opens or closes the access of the gases to a first or an additional cyclone as a function of the dynamic pressure of the crankcase gas. A compression spring is provided to reset the control plunger or as a force component acting against the dynamic pressure of the crankcase gas. This makes it possible to efficiently control and divide the volumetric flow into several partial streams.

In accordance with a further embodiment of the invention, the access to the at least two cyclones is cylindrical and contains a mounting pin to receive the compression spring and the control plunger. According to this embodiment, three cyclones are advantageously provided, and the control piston has a passage in the bottom and is in communication with the first cyclone. Thus, if the volumetric flow is very low, only the first cyclone is active and separates the liquid from the gases, but if a higher volumetric flow needs to be cleaned, the control piston moves against the force of the compression spring out of its rest position and opens an additional passage for the volumetric flow, and if the volumetric flow increases further, a third aperture to the third cyclone is opened. Consequently, if the volumetric flow is at its maximum, all three cyclones admit flow and are available for cleaning the crankcase gas. To seal the control plunger and its lateral surface, the control plunger may be provided with suitable seal rings.

The cyclones are advantageously arranged in a common housing. This housing has a bottom outlet, which in a further refinement of the invention is provided with a valve and adapted to return the collected liquid to the liquid circuit, e.g., the oil circuit of the internal combustion engine.

The volumetric flow may also be controlled via a diaphragm valve. This diaphragm valve is controlled by the pressure differential between the pressure of the crankcase gas in front or upstream of the cyclone, i.e., the pressure of the oil-laden crankcase gases, and the pressure of the crankcase gases behind or downstream of the cyclone. The pressure differential causes additional cyclones to open or close. At a maximum pressure differential, all cyclones are open.

In accordance with a further preferred embodiment of the invention, the diaphragm valve is made of an elastic diaphragm biased by a compression spring. On this diaphragm two tappets are provided on a disk. The tappets close or open the access to two cyclones. Instead of a disk and the tappets, the diaphragm valve alternatively may comprise a plunger that moves along a cylinder wall. Openings are provided in this cylinder wall, which are in communication with the cyclones, and these openings are closed or opened by the movement of the plunger. This relatively simple construction is likewise suitable for controlling the distribution of the crankcase gases and thus achieving an optimal cleaning action.

These and other features of preferred embodiments of the invention, in addition to being set forth in the claims, are also disclosed in the specification and/or the drawings, and the individual features each may be implemented in embodiments of the invention either alone or in the form of subcombinations of two or more features and can be applied to other fields of use and may constitute advantageous, separately protectable constructions for which protection is also claimed.

BRIEF DESCRIPTION OF THE DRAWINGS

The invention will be described in further detail hereinafter with reference to illustrative preferred embodiments shown in the accompanying drawings, in which.

DETAILED DESCRIPTION OF PREFERRED EMBODIMENTS

Figure 1:
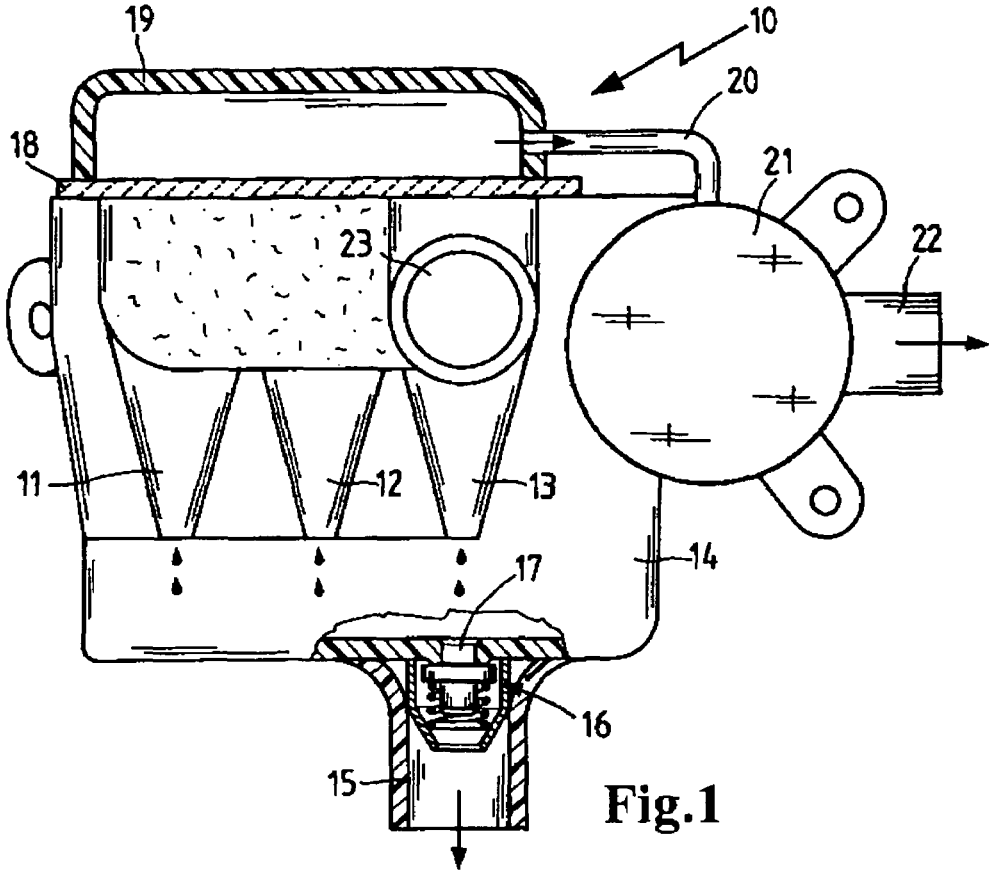
FIG. 1 is a schematic representation of an apparatus according to the invention for deoiling crankcase gases.

The apparatus 10 depicted in FIG. 1 comprises three cyclones 11, 12, 13, which are arranged in a common housing 14. The housing has a bottom outlet 15, which is closed by an outlet valve 16. The outlet valve 16 opens the opening 17 when a specific liquid pressure acts on the valve. The housing 14 is closed with a cover 18. Located above the cover 18 is an end element 19, which receives the crankcase ventilation gases cleaned by the cyclones 11, 12, 13. These gases are guided to the outlet pipe 22 via the pipe 20 and a pressure control valve 21. The clean crankcase gases can be supplied to the intake tract of an internal combustion engine. The oil-laden gases flow into the apparatus through the opening 23.

Figure 2:
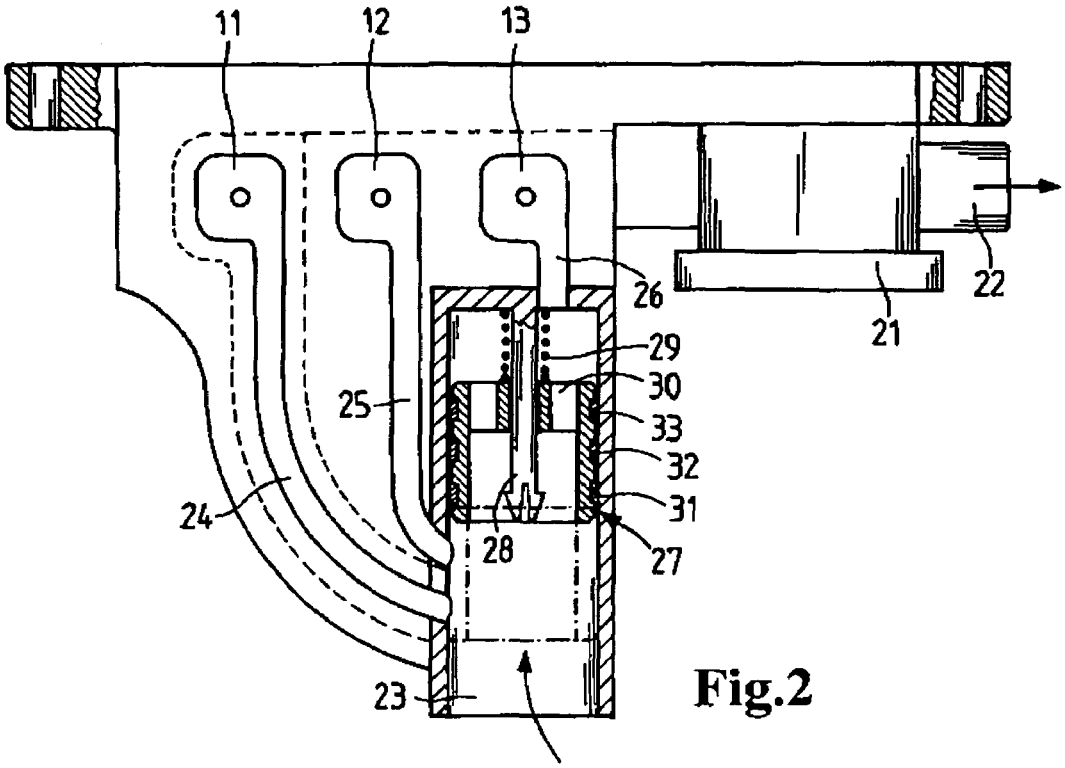
FIG. 2 is a schematic top view of the apparatus of FIG. 1.

Opening 23 is shown in greater detail in FIG. 2. In this figure, like components are identified by the same reference numerals. The cyclones 11, 12, 13 are depicted in a plan view. Feed lines 24, 25 and 26 open from common opening 23 and lead to the respective cyclones. The opening 23 is cylindrical and has a control plunger 27 arranged therein. The control plunger 27 is mounted on and simultaneously guided by a mounting pin 28. A compression spring 29 is pushed over the holding pin and biases the control plunger toward the opening 23, i.e, the spring 29 exerts a force on the control plunger in the direction of the opening 23. The control plunger 27 has at least one opening 30 on the bottom facing the compression spring. Thus, the inlet opening 23 for the oil-laden crankcase gases is in communication with the feed line 26 for the cyclone 13. This means that in a first position of the control plunger indicated by broken lines in which the control plunger closes the feed lines 24 and 25, only the feed line 26 is in communication with the opening 23, so that the oil-laden crankcase gases are fed only to the cyclone 13. If the volumetric flow and thus the dynamic pressure on the control plunger 27 increase, the control plunger moves toward the cyclone 13 against the force of the compression spring 29 and initially opens the feed line 24 leading to cyclone 11. Thus, two cyclones for cleaning the crankcase gases are active. If the dynamic pressure increases further, the control plunger also opens the feed line 25 leading to cyclone 12, so that all three cyclones admit crankcase gases. The control plunger is equipped with three seal rings 31, 32, 33, which assure that the crankcase gases are correctly and optimally supplied to the individual cyclones in every position of the control plunger.

Figure 3:
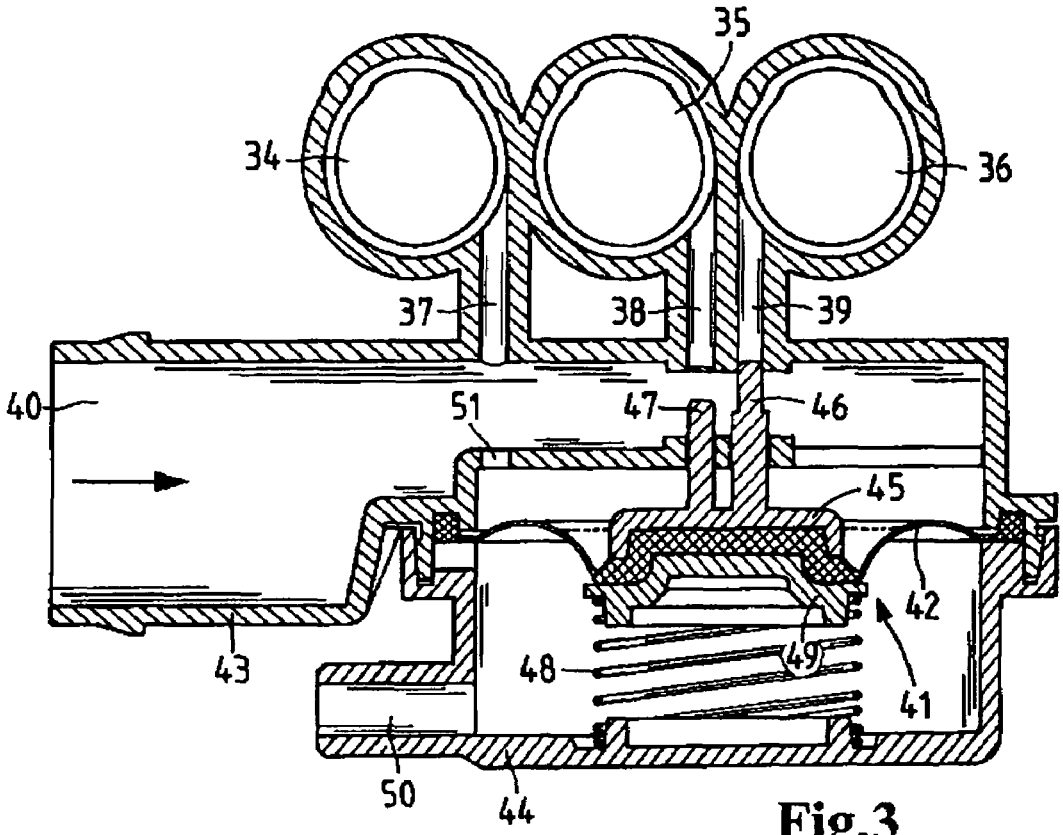
FIG. 3 is a depiction of a variant apparatus with a diaphragm valve.

FIG. 3 shows another configuration of an apparatus according to the invention for deoiling crankcase ventilation gases comprising three cyclones 34, 35 and 36. Each of the cyclones has its own feed line 37, 38 and 39, respectively. The oil-laden crankcase gases reach the feed lines via the opening 40. A diaphragm valve 41 is provided to control the distribution of the volumetric flows to the cyclones. This diaphragm valve is comprised of a flexible or elastic rubber diaphragm 42, which is clamped between the housing 43 and a cover 44. The center of rubber diaphragm 42 carries a disk 45 on which two tappets 46, 47 are disposed. The tappet 46 closes the feed line 39, and the tappet 47 the feed line 38. In the illustrated position of diaphragm 42 and disk 45, the feed line 38 is open, while the feed line 39 closed. On the side of the rubber diaphragm 42 opposite the disk, a compression spring 48 and a spring guide 49 are provided. The compression spring 48 exerts a force on the rubber diaphragm 42 in the direction of the feed lines 38, 39 and thus biases the diaphragm valve toward the position in which feed lines 38 and 39 are closed. The space within the cover 44 communicates via the opening 50 with the feed line for the gases cleaned by the cyclone, such that the pressure of the connecting line extends into the space within the cover 44. The opposite side of the rubber diaphragm 42 is subject to the pressure of the oil-laden crankcase gases through the opening 51. This means that if the pressure on the side of the oil-laden gas is low, the tappets 46, 47 close the feed lines 38, 39. If the pressure on the side of the oil-laden gas increases, the diaphragm 42 is urged against the force of the compression spring 48 and moves in the direction of the compression spring, such that first the feed line 38 and then the feed line 39 are opened.

Figure 4:
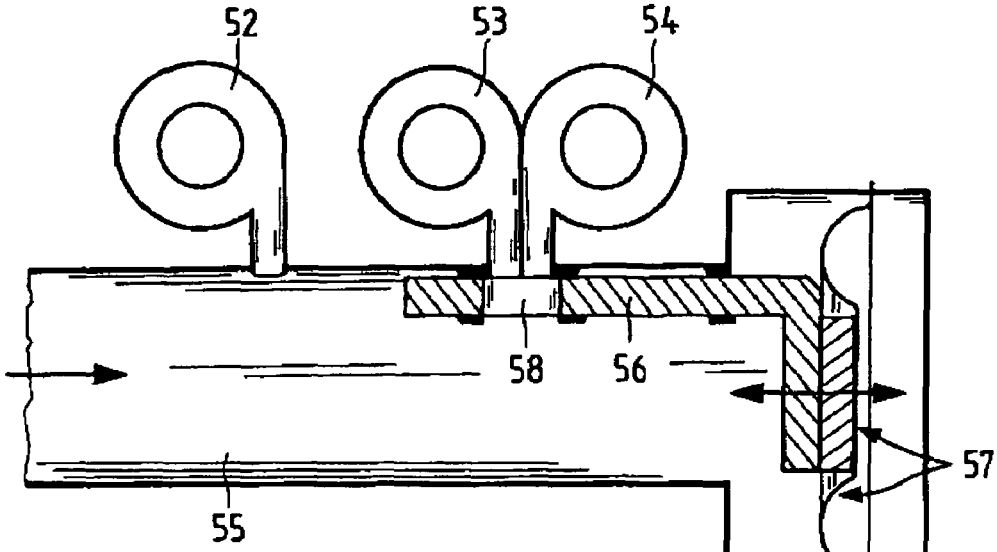
FIG. 4 is an illustration of a further variant with a diaphragm plate.

FIG. 4 schematically illustrates another solution to controlling the gas distribution among the cyclones 52, 53, 54. The cyclones are situated next to a crankcase ventilation gas feed line 55. Within the feed line 55 there is a slide valve 56, which is attached to a diaphragm 57. In this embodiment the diaphragm is likewise subject to the pressure of the clean gas on the right and the oil-laden gas on the left. The slide valve 56 has a passage 58. While the cyclone 52 is open in every operating state, the opening 58 shifts depending on the pressurization of the diaphragm and opens the cyclone 53, 54 depending on the pressure differential across the diaphragm. As in the other embodiments, a compression spring (not shown) may be provided to bias the valve toward a position in which access to one or both of cyclones 53 and 54 is blocked.

Figure 5:
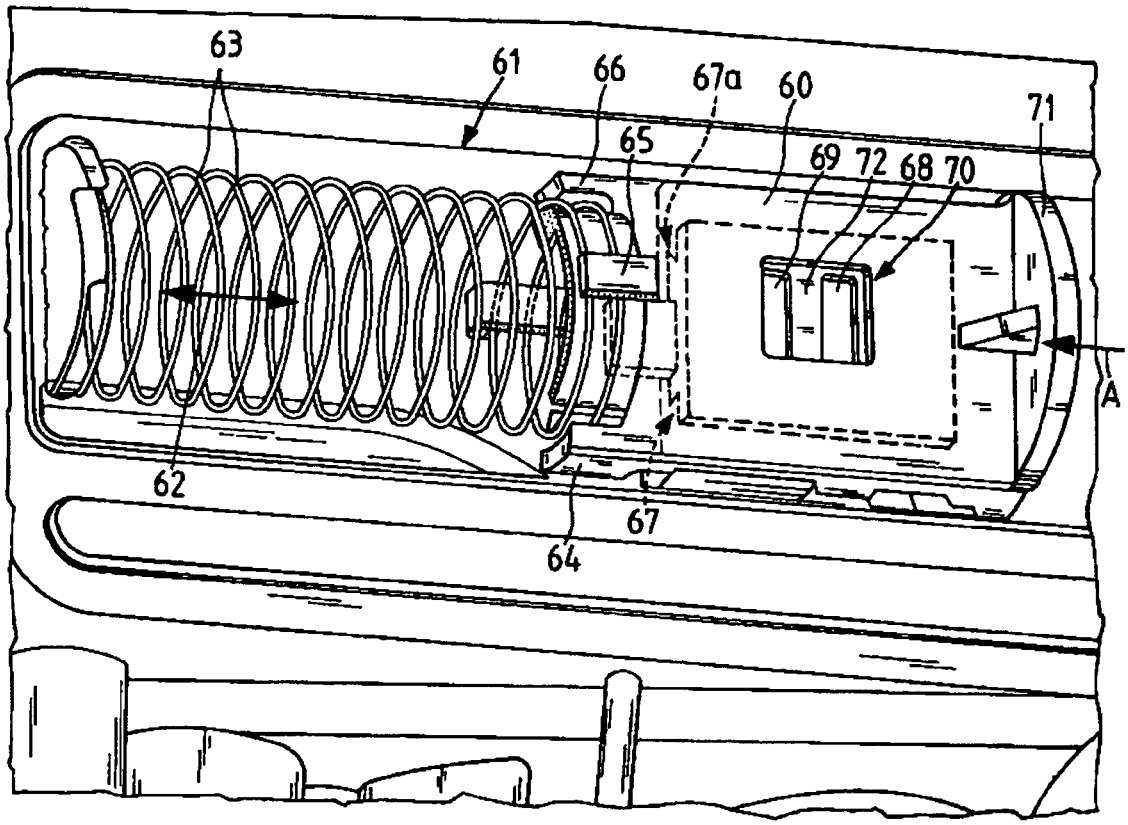
FIG. 5 is a three-dimensional representation of a valve for controlling the switching of cyclones.

FIG. 5 is a three-dimensional representation of a housing for a control plunger 60 similar in construction to that shown in FIG. 2. Control plunger 60 is located in a cylindrical housing 61 and can move therein in the direction of the arrow 62. The support at the end of the housing is effected via a compression spring 63. This compression spring is affixed to the control plunger 60 by brackets 64, 65, 66. The control plunger is subject to the flow pressure of the crankcase gas in direction A against the end plate 71. Depending on the volumetric flow, this flow pressure causes plunger 60 to move against the pressure of the spring 63. Because of an annular gap between the end plate 71 and the housing wall 61, the crankcase gas can flow past the end plate and reach a first cyclone. The control plunger 60 is displaceably mounted on a support 72. This support 72 has guide surfaces 67, 67*a*. The support 72 is clasped by the control plunger 60 in the region of these guide surfaces and the peripheral wall arranged in this region. The control piston 60 can move along the support 72 on this dovetail guide. Two openings 68, 69 are provided in the support 72 itself. These openings communicate with the other cyclones (not shown). A window 70 on the control plunger 60 opens these openings 68, 69 or closes them if the crankcase gas pressure is low. In the position shown here, the crankcase gas pressure is at its maximum, i.e., these two cyclones and a continuously open cyclone are all open. If the crankcase gas pressure drops, the control plunger first closes the opening 69 and then the opening 68. This configuration shows a simple and effective valve to control and distribute the crankcase gas stream among the several cyclones. It is of course also possible to control a plurality of cyclones by using corresponding configurations of the window 70 or additional openings below this window.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. An apparatus for separating oil from crankcase ventilation gases of an internal combustion engine, said apparatus comprising at least two oil separator cyclones connected in parallel through which the crankcase ventilation gases flow, and a control member which divides the volumetric flow of the crankcase ventilation gases into partial streams depending on the size of the volumetric flow and guides the partial streams into at least one of the oil separator cyclones, said control member comprising a control plunger and a compression spring which urges the control plunger against the pressure of the crankcase gases, said control plunger opening or blocking access of the gases to additional cyclones of said at least two oil separator cyclones depending on the dynamic pressure of the crankcase gases, and wherein the access to the at least two cyclones has a cylindrical configuration and contains a mounting pin on which the compression spring is mounted.

2. An apparatus according to claim 1, wherein said apparatus comprises first, second and third cyclones, and a passage communicating with the first cyclone is formed in the bottom of the control plunger; wherein when said control plunger is a rest position, a lateral surface of the control plunger blocks access of the gases to both the second and third cyclones, and wherein when the volumetric flow of crankcase ventilation gases is at a maximum, the dynamic pressure of the gases shifts the control plunger axially to open the access to the second and third cyclones.

3. An apparatus according to claim 2, wherein the control plunger is provided with seal rings on its lateral surface.

4. An apparatus according to claim 2, wherein the cyclones are arranged in a common housing having a bottom outlet for discharging separated liquid.

5. An apparatus according to claim 4, wherein the bottom outlet is provided with a valve.

6. An apparatus for separating oil from crankcase ventilation gases of an internal combustion engine, said apparatus comprising at least two oil separator cyclones connected in parallel through which the crankcase ventilation gases flow, and a control member which divides the volumetric flow of the crankcase ventilation gases into partial streams depending on the size of the volumetric flow and guides the partial streams into at least one of the oil separator cyclones, said control member comprising a control plunger and a compression spring which urges the control plunger against the pressure of the crankcase gases, said control plunger opening or blocking access of the gases to additional cyclones of said at least two oil separator cyclones depending on the dynamic pressure of the crankcase gases, and wherein said control member comprises a diaphragm valve for regulating the volumetric flow of crankcase ventilation gases, said diaphragm valve being controlled by the differential between the pressure of the crankcase ventilation gas upstream of the first cyclone and the pressure of the crankcase ventilation gas downstream of the first cyclone such that a low or non-existent pressure differential causes access to additional cyclones to be blocked, and a maximum pressure differential causes access to all cyclones to be opened.

7. An apparatus according to claim 6, wherein the diaphragm valve comprises a flexible diaphragm which is biased by the compression spring, said diaphragm valve when in a rest position closing openings to two cyclones by two tappets disposed on a disk, wherein the diaphragm valve is arranged in a housing, and the housing is in communication with the crankcase ventilation gas upstream of the cyclones on one side of the diaphragm and with the crankcase ventilation gas downstream of the cyclones on the other side of the diaphragm.

8. An apparatus according to claim 6, wherein the diaphragm valve comprises a plunger, which moves along a cylinder wall and opens or closes access openings in the cylinder wall which lead to the cyclones.

* * * * *